US005554813A

United States Patent [19]

Kakishita

[11] Patent Number: 5,554,813

[45] Date of Patent: Sep. 10, 1996

[54] TONE SIGNAL SYNTHESIZER EMPLOYING A CLOSED WAVE GUIDE NETWORK

[75] Inventor: Masahiro Kakishita, Hamamatsu, Japan

[73] Assignee: Yamaha Corporation, Japan

[21] Appl. No.: 436,924

[22] Filed: May 8, 1995

Related U.S. Application Data

[63] Continuation of Ser. No. 76,908, Jun. 15, 1993, abandoned.

[30] Foreign Application Priority Data

Jun. 16, 1992 [JP] Japan ..... 4-181681

[51] Int. Cl.[6] ..... G10H 7/00; G10H 1/06

[52] U.S. Cl. ..... 84/622; 84/630; 84/659

[58] Field of Search ..... 84/600, 622, 630, 84/659, 661, DIG. 9, DIG. 10

[56] References Cited

U.S. PATENT DOCUMENTS 4,984,276 1/1991 Smith .
5,117,729 6/1992 Kunimoto .
5,187,313 2/1993 Inoue .
5,220,117 6/1993 Yamada et al. ..... 84/600
5,286,913 2/1994 Higashi ..... 84/622

*Primary Examiner*—William M. Shoop, Jr.
*Assistant Examiner*—Jeffrey W. Donels
*Attorney, Agent, or Firm*—Graham & James LLP

[57] ABSTRACT

In a closed wave guide network having a bidirectional signal transmitting channel section and a signal junction section, signal delay time is variably controlled by a first parameter group so as to control the resonance frequency characteristics of the wave guide network. A signal excitor is connected to the wave guide network so that an excited signal is supplied to the network. The excitation frequency of the excitor is controlled in accordance with a second parameter group. There are also provided a combination determination section which, in correspondence to the pitch of a tone to be generated, determines a combination of the first parameter group to be used in the wave guide network and the second parameter group to be used in the excitor, and a parameter generator which, in accordance with the combination determined by the combination determination section, generates and supplies individual parameters of the first and second parameter groups. The pitch of a tone to be generated is determined by a combination of the resonance characteristics of the wave guide network and the excitation frequency of the signal excitor.

15 Claims, 8 Drawing Sheets

| KEY CODE | TUBE LENGTH SELECTION DAT | TUBE LENGTH COMPENSATION DAT |
|---|---|---|
| $C_0$ | 0 | 0 |
| $C_0^{\#}$ | 1 | 0 |
| ⋮ | ⋮ | ⋮ |
| $B_0$ | 11 | 0 |
| $C_1$ | 12 | 0 |
| ⋮ | ⋮ | ⋮ |
| $B_1$ | 23 | 0 |
| $C_2$ | 24 | 0 |
| ⋮ | ⋮ | ⋮ |
| $B_2$ | 35 | 0 |
| $C_3$ | 24 | ××× |
| ⋮ | ⋮ | ⋮ |
| $B_3$ | 35 | ××× |
| $C_4$ | 24 | ××× |
| ⋮ | ⋮ | ⋮ |
| $B_4$ | 35 | ××× |
| $C_5$ | 29 | ××× |
| ⋮ | ⋮ | ⋮ |
| $F_5^{\#}$ | 35 | ⋮ |
| $G_5$ | 31 | ⋮ |
| ⋮ | ⋮ | ⋮ |
| $B_5$ | 35 | |

F I G. 6 A

| KEY CODE | PEGISTER KEY |
|---|---|
| $C_0$ | |
| $C_0^{\#}$ | CLOSED STATE |
| ⋮ | |
| $B_2$ | (RGKD = +1) |
| $C_3$ | |
| ⋮ | OPEN STATE |
| | (RGKD = −1) |

F I G. 6 B

| KEY CODE | MODE NO. | |
|---|---|---|
| | NLMODE | MODE |
| $C_0$ | 1 | 1 |
| ⋮ | ⋮ | ⋮ |
| $C_0^{\#}$ | ⋮ | ⋮ |
| ⋮ | ⋮ | ⋮ |
| $B_2$ | 1 | 1 |
| $C_3$ | 1 | 2 |
| ⋮ | ⋮ | ⋮ |
| $B_3$ | 1 | 2 |
| $C_4$ | 2 | 2 |
| ⋮ | ⋮ | ⋮ |
| $B_4$ | 2 | 2 |
| $C_5$ | 3 | 2 |
| ⋮ | ⋮ | ⋮ |
| $F_5^{\#}$ | 3 | 2 |
| $G_5$ | 4 | 2 |
| ⋮ | ⋮ | ⋮ |
| $B_5$ | 4 | 2 |

F I G. 8 A

| MODE NO. | EMBOUCHUR OFFSET |
|---|---|
| 1 | 0 |
| 2 | 0.5 |
| 3 | 0.75 |
| 4 | 0.875 |

F I G. 8 C

| MODE NO. | PRESSURE COEFFICIENT |
|---|---|
| 1 | 1.0 |
| 2 | 1.05 |
| 3 | 1.1 |
| 4 | 1.2 |

F I G. 8 B

TONE SIGNAL SYNTHESIZER EMPLOYING A CLOSED WAVE GUIDE NETWORK

This is a continuation of application Ser. No. 08/076,908, filed on Jun. 15, 1993, now abandoned.

BACKGROUND OF THE INVENTION

This invention relates to a tone signal synthesizer employing a closed wave guide network and more particularly to such a tone signal synthesizer which is capable of accurately or faithfully simulating tones of natural musical instruments such as natural wind instruments and is also capable of achieving a natural connection of tones.

In sounding tones of desired pitches by a natural wind instrument, the player controls or adjusts the length of the instrument's tubular body (including the opening and closing movement of register keys) and also blow action on the reed section of the mouthpiece (or bite action on the reed).

From the viewpoint of acoustics, to determine the length of the tubular body by, for example, opening and closing the register keys means to determine the resonant frequency in the tubular body. In other words, the tubular body functions as a comb filter with a resonance frequency variably determined from among a given fundamental frequency f and related harmonic frequencies 2f, 3f . . . nf. In response to the player's blow action on the reed section of the mouthpiece, a specific resonance frequency of the tubular body is determined. For explanation, an operation mode of the reed section which causes resonance of the tubular body at the fundamental frequency f will be called a first-order mode, an operation mode which causes resonance at the second-harmonic frequency 2f two times higher than the fundamental will be called a second-order mode, and so on. Namely, an operation mode which causes resonance at the nth harmonic frequency nf n times higher than the fundamental will be called an n-order mode.

By the way, tone waveshape signal forming devices, namely, tone signal synthesizers are conventionally known which simulate the operation of a natural musical instrument such as a wind instrument by the use of electronic circuitry (including software), so as to form tone signals approximating tones of the natural musical instrument. Some of the known tone waveshape signal forming devices employ a closed wave guide network as a tone synthesis means suitable for simulating tones of a wind instrument. The wave guide network comprises a waveshape signal circulation path which is composed of delay circuits and filters connected in a closed loop. An excitation signal is supplied to this circulation path for circulation therethrough, and an output tone signal is taken out from any suitable location along the circulation path. The basic idea of such a wave guide is taught in U.S. Pat. No. 4,984,276.

To describe a case where a wind instrument is simulated, the above-mentioned circulation path corresponds to a tubular body of the wind instrument, and the delay times achieved by delay circuits provided in the circulation path generally corresponds to the length of the tubular body. In some cases, there are also provided circuits corresponding to register keys. Hereinafter, such a circuitry section which makes up the circulation path will be called a "linear section". To this linear section, there are supplied various parameters such as a parameter corresponding to the above-mentioned tubular body length, and a parameter corresponding to the open and closed state of the register keys. The linear section operates in accordance with the supplied parameters, so as to circulate the waveshape signal. The resonance frequency f, 2f, 3f . . . n of the linear section is determined in accordance with the supplied parameters.

A section for generating the excitation signal to be supplied to the linear section corresponds to the reed section (section including the reed) of the wind instrument and will hereinafter be called a "non-linear section". To this non-linear section, there are supplied various parameters such as a parameter corresponding to a breadth pressure applied to the reed section of the wind instrument (pressure parameter), a parameter corresponding to the manner in which the player's mouth contacts the reed section and/or the player bites the reed section (embouchure parameter), and a parameter specifying frequency characteristics of the reed. The non-linear section operates in accordance with the supplied parameters, so as to generate the excitation signal. The operation mode of the non-linear section (which corresponds to the operation mode of the reed section of the wind instrument and will hereinafter be called a "non-linear section operation mode") is determined in accordance with the supplied parameters.

As mentioned above, the tone signal synthesizers employing the wave guide network receives predetermined parameters at the linear section and non-linear section, in such a manner that it operates with the resonance frequency and the non-linear section operation mode as determined by these parameters, thereby simulating a desired natural musical instrument in order to form tone signals of desired pitches.

Improved tone signal synthesizers employing the closed wave guide network are disclosed in U.S. Pat. No. 5,117,729 and in U.S. Pat. No. 5,187,313. According to the disclosure in the first-named U.S. Patent, there is provided a particular signal transfer passage extending from a signal supply line of the network in the linear section to a return signal line. The particular signal transfer passage functions to exchange signals between the two lines in such a manner that it is allowed to simulate characteristics of air flow right behind a gap between the mouthpiece and reed of a natural wind instrument. According to the disclosure in the second-named U.S. Patent, there is provided a signal decay means in a signal junction portion which first processes an excitation signal input from the non-linear section, so as to control a transfer gain of the first-order resonance frequency in so that a resonance frequency of a desired order can be obtained.

However, with the prior art tone signal synthesizer employing the closed wave guide network, no detailed study or consideration was not made on the relationship between the pitch of a tone to be generated and parameters to be supplied to the network for achieving the pitch. Thus, there was no other approach for achieving the pitch than variably controlling only one parameter by, for example, varying the signal delay length in the wave guide. But, such an approach was never sufficient for faithfully simulating tones of a natural musical instrument.

SUMMARY OF THE INVENTION

Therefore, it is an object of the present invention to provide a tone signal synthesizer employing a closed wave guide network which allows parameters to be set in the wave guide network in an optimum operation mode for each pitch of tones to be generated, to thereby faithfully simulate tone of a natural musical instrument.

It is another object of the present invention to provide a tone signal synthesizer employing a closed wave guide network which is capable of achieving a natural connection of tones when the tone to be generated is changed from one to another.

In order to accomplish the above-mentioned objects, a tone signal synthesizer according to the present invention comprises signal circulation section including a bidirectional signal transmitting channel section which has a channel for transmitting a wave signal in an advancing direction and a channel for transimitting the wave signal in a reflecting direction and a signal junction section for controlling advancement and reflection of the wave signal at a boundary of said signal transmitting channel section, a delay time in said signal delay section channel being variably controlled by a first parameter group so as to control a resonance characteristic of said signal circulation section, an excitation section for exciting the wave signal to be supplied to said signal circulation section, an excitation frequency of said excitation section being controlled in accordance with a second parameter group, the wave signal circulating in said signal circulation section being taken out as a tone signal, a pitch of said tone signal being determined by a combination of the resonance frequency of the signal circulation section and the excitation frequency of the excitation section, a combination determination section for determining a combination of the first parameter group to be used in the signal circulation section and the second parameter group to be used in the excitation section, in correspondence to a pitch of a tone to be generated; and a parameter generation section for, in accordance with the combination determined by the determination section, generating individual parameters of said first and second parameter groups and supplying thus-generated parameters to the signal circulation section and excitation section.

Because the combination of the first parameter group to be used in the signal circulation section and the second parameter group to be used in the excitation section is determined in correspondence to the pitch of a tone to be generated, parameters can be set in the closed wave guide network in an optimum operation mode for each tone pitch, so that it is allowed to faithfully simulate tones of a natural musical instrument. The permits a proper use of parameters in a variable manner as desired by the player. For example, even when the same tone pitch is to be achieved, the tone pitch for a certain tone color can be achieved by one arrangement such that the signal delay length to be established by the first parameter group is made longer while the excitation frequency to be established by the second parameter group is made relatively higher, and the tone pitch for another tone color can be achieved by another arrangement such that the signal delay length to be established by the first parameter group is made shorter while the excitation frequency to be established by the second parameter group is made relatively lower. Consequently, optimum simulation of natural musical instrument tones can be provided. In addition, even when tones to be generated are of the same tone color, optimum simulation of natural musical instrument tones corresponding to the pitch range can be provided by changing the combination of the first and second parameter groups. For example, it is possible to perform such a control that, for one pitch range, the desired tone pitch is achieved by only changing the signal delay length to be established by the first parameter group, while, for another pitch range, the desired tone pitch is achieved by also changing the excitation frequency to be established by the second parameter group. This control is very useful for simulating a physical model of, for example, a wind instrument as faithfully as possible with a simple construction.

According to the present invention, when there is instructed generation of a tone of a same pitch as a last generated tone, the individual parameters of the first and second parameter groups used for the last generated tone are maintained, so as not to effect any parameter change processing. This allows a natural connections of generated tones without giving a feeling of a break between tones.

The first parameter group may contain, for example, a parameter corresponding to the length of a tubular body (delay amount of delay circuit inserted in the channel) in the signal circulation section (linear section) and a parameter corresponding to a closed and open state of a register key. Further, the second parameter group may contain, for example, parameters specifying embouchure and pressure (breath pressure) and frequency characteristics of a reed.

What are input to the device may be other pitch specifying performance information or tone color control information, and parameters may be generated in accordance with such information. The tone color control information specifies the tone color of a tone to be generated. The other pitch specifying performance information than the tone pitch information may be embouchure and pressure data.

The tone pitch information and the other pitch specifying performance information are input from, for example, an operation device simulating a wind instrument which includes a pressure sensor and a sensor for detecting closed and open states of the register key. Alternatively, a keyboard may be used, or data directly input from a suitable exterior device may be used.

Values of the input embouchure and pressure data may be supplied as the second group parameters to the excitation section (non-linear section) after having been modified as necessary in accordance with the tone color and pitch. This allows the excitation section (non-linear section) to be driven with the embouchure and pressure corresponding to the tone color and pitch. Namely, when a tone of a certain pitch is to be generated, the non-linear section can operate in the same operation mode as a natural musical instrument generates such a tone.

Further, a key code (tone pitch information) indicative of the pitch of a tone may be input in such a manner that a delay time value corresponding to the pitch (which corresponds to the length of the tubular body of a wind instrument to be simulated) is supplied as the first group parameter to the linear section. In the case where a component corresponding to the register key of a wind instrument is provided in the linear section, a parameter related to the closed or open state of the register key may be generated and supplied in accordance with the key code. When a tone of the same pitch is to be generated, several combinations of the tubular body length and the closed or open state of the register key can be considered. In this case, by generating and supplying the first group parameters in such a combination as in the natural musical instrument to be simulated, a tone signal can be generated under the same conditions as when such a tone is generated, i.e., in a combination of the tubular body length and the closed or open state of the register key.

When generation of a tone signal of a certain tone color is instructed in the case where a look-up table is provided for each selectable tone color, a table corresponding to the tone color may be used to obtain parameters corresponding to the tone pitch (such as parameters which specify the tubular body length, closed or open state of the register key, embouchure, pressure and frequency characteristics of the reed), to provide the first and second parameter groups. Moreover, as for the embouchure and pressure, offset values or coefficients corresponding to the tone pitch (or the non-linear-section operation mode corresponding to the tone pitch) may be obtained from a table corresponding to a tone color, in such a manner that the offset values are added to the embouchure and pressure values as input performance information, or the coefficients are multiplied with the embouchure and pressure values. The embouchure and pressure may be modified in other ways than such addition or multiplication.

Preferred embodiments of the present invention will be described below in greater detail with reference to the accompanying drawings.

BRIEF DESCRIPTION OF THE DRAWINGS

In the accompanying drawings:

FIG. 6A is a view illustrating example contents of a tube length control table;

FIG. 6B is a view illustrating example contents of a register key control table;

FIG. 8A is a view of an example of a mode selection table shown in FIG. 7;

FIG. 8B is a view of an example of a pressure table shown in FIG. 7;

FIG. 8C is a view of an example of an embouchure table shown in FIG. 7.

DETAILED DESCRIPTION OF THE PREFERRED EMBODIMENTS

Before describing the structure of a tone waveshape signal forming device, namely, a tone signal synthesizer in accordance with a preferred embodiment of the present invention, description will first be made on a wind instrument employed in the embodiment.

Figure 1:
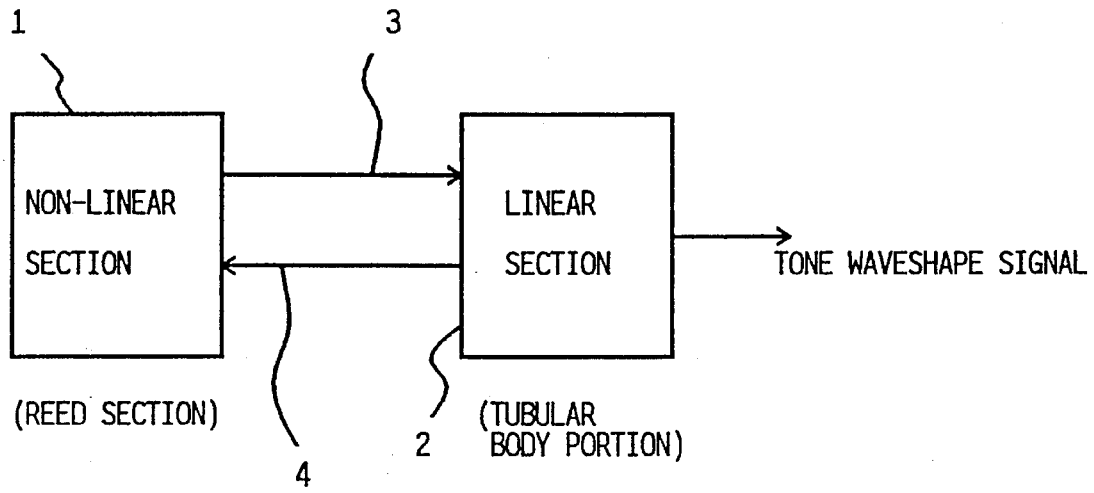
FIG. 1 is a block diagram illustrating a wind instrument model that is employed in a tone waveshape signal forming device in accordance with an embodiment of the present invention.
Figure 3:
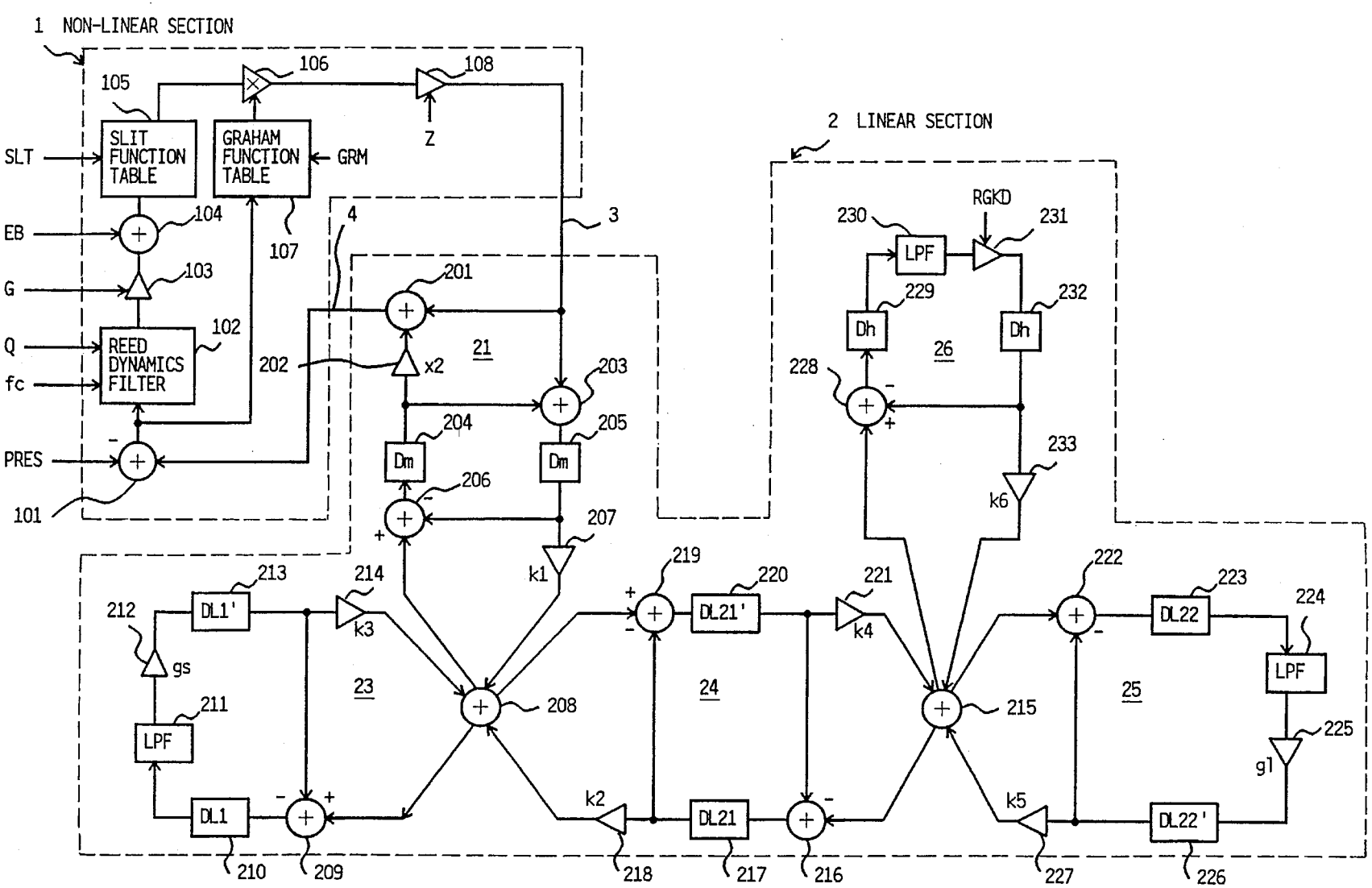
FIG. 3 is a circuit diagram illustrating a specific example of the wind instrument model shown in FIG. 1.

FIG. 1 is a block diagram illustrating the wind instrument model that is employed in the tone waveshape signal forming device in accordance with the preferred embodiment, and FIG. 3 is a detailed circuit diagram of the wind instrument model.

In this illustrated example, the wind instrument model is composed of a non-linear section 1 and a linear section 2. The non-linear section 1 and linear section 2 correspond to the reed section and tubular body section of a natural wind instrument, respectively. Reference numeral 3 represents a signal line that provides a supply path of excitation signals from the non-linear section 1 to the linear section 2, while reference numeral 4 represents a signal line that provides a return path of waveshape signals from the linear section 2 to the non-linear section 1.

The non-linear section 1 receives predetermined parameters (second parameters), in accordance with which it generates excitation signals. The linear section 2 receives predetermined parameters (first parameters) as well as the excitation signals supplied from the non-linear section 1. In accordance with these parameters and excitation signals, the linear section 2 circulates tone signals through an interior circulation path. The waveshape signals are taken out from a suitable location of the interior circulation path in the linear section 2.

The wind instrument model will be described in more detail with reference to the circuit diagram of FIG. 3. As shown, the non-linear section 1 comprises an adder 101, a reed dynamics filter 102, a multiplier 103, an adder 104, a slit function table 105, a multiplier 106, a graham function table 107, and a multiplier 108.

The adder 101 subtracts a pressure value PRES from a waveshape signal fed back via the signal line 4 providing the return path of the waveshape signal. In this case, the waveshape signal fed back via the signal line 4 represents a reflected wave which has propagated from the linear (tube body) section 2 to the non-linear (reed) section 3. Thus, this subtraction simulates such conditions that the reed in the natural wind instrument is caused to displace in response to a differential pressure between the pressure PRES and the reflected wave pressure and an incident wave is formed in response to the displacement of the reed. In other words, the adder 101 provides an output corresponding to the differential pressure that causes the displacement of the reed.

The output of the adder 101 is given to the reed dynamics filter 102 which in turn acts to achieve dynamic characteristics of the reed. Parameter Q supplied to the reed dynamics filter 102 indicates a peak sharpness, and parameter fc also supplied to the reed dynamics filter 102 indicates a cut-off frequency. The output of the reed dynamics filter 102 is multiplied in the multiplier 103 by parameter G indicative of a slit gain and is then added with an embouchure value EB. The multiplication by the slit gain parameter G is performed in order to control the gradient of a slit function with the parameter G as will be described later, and the addition with the embouchure value EB is performed in order to simulate such conditions that the reed displacement amount is affected by the shape and tightness of the player's lips.

The output of the adder 104 is given to the slit function table 105. The slit function table 105, which is a non-linear table for simulating a reed displacement amount corresponding to an applied pressure, provides data indicative of a reed displacement amount corresponding to the input pressure. Parameter SLT designates a non-linear function table to be used as the slit function table 105.

The output of the slit function table 105 is delivered to the multiplier 106, to which the differential pressure signal output from the adder 101 is also supplied as a multiplier ("multiplier" in this sense will be hereinafter called "multiplication coefficient" to distinguish from the hardware multipliers) via the graham function table 107. The graham function table 107 serves to simulate such conditions that as the differential pressure increases more than a predetermined level in a narrow tubular passage, the flow rate gets saturated in such a manner that the differential pressure is not directly proportional to the flow rate. By the use of this graham function table 107, a differential pressure signal having been compensated in consideration of the influence which the differential pressure has on the flow rate in the reed section will be supplied as a multiplication coefficient to the multiplier 106. Parameter GRM designates a table to be used as the graham function table 107.

The multiplier 106 multiplies the output from the slit function table 105 with the output from the graham function table 107. The result is that the output signal from the multiplier 106 indicates a volume flow rate of air in the reed section. Then, the output from the multiplier 106 is multiplied in the multiplier 108 by a fixed coefficient Z that is indicative of impedance (air resistance) within the mouthpiece. The multiplication result is then supplied, as an excitation signal (tone pressure signal), to the linear section 2 via the signal line 3.

Next, description will be made on the linear section 2 of FIG. 3.

The linear section 2 comprises a junction portion simulating circuit 21 and a plurality of tubular portion simulating circuits 22, 23, 24, 25, 26. The junction portion simulating circuit 21 is composed of an adder 201, a multiplier 202 and an adder 203.

The tubular portion simulating circuit 22 is composed of delay circuits 204, 205, an adder 206 and a multiplier 207. The tubular portion simulating circuit 23 is composed of an adder 209, a delay circuit 210, a low-pass filter 211, a multiplier 212, a delay circuit 213 and a multiplier 214. The tubular portion simulating circuit 24 is composed of an adder 216, a delay circuit 217, a multiplier 218, an adder 219, a delay circuit 220 and a multiplier 221. The tubular portion simulating circuit 25 is composed of an adder 222, a delay circuit 223, a low-pass filter 224, a multiplier 225, a delay circuit 226 and a multiplier 227. The tubular portion simulating circuit 26 is composed of an adder 228, a delay circuit 229, a low-pass filter 230, a multiplier 231, a delay circuit 231 and a multiplier 233.

The tubular portion simulating circuits 22–24 are interconnected via an adder 208, and the tubular portion simulating circuits 24–26 are interconnected via an adder 215.

Figure 2:
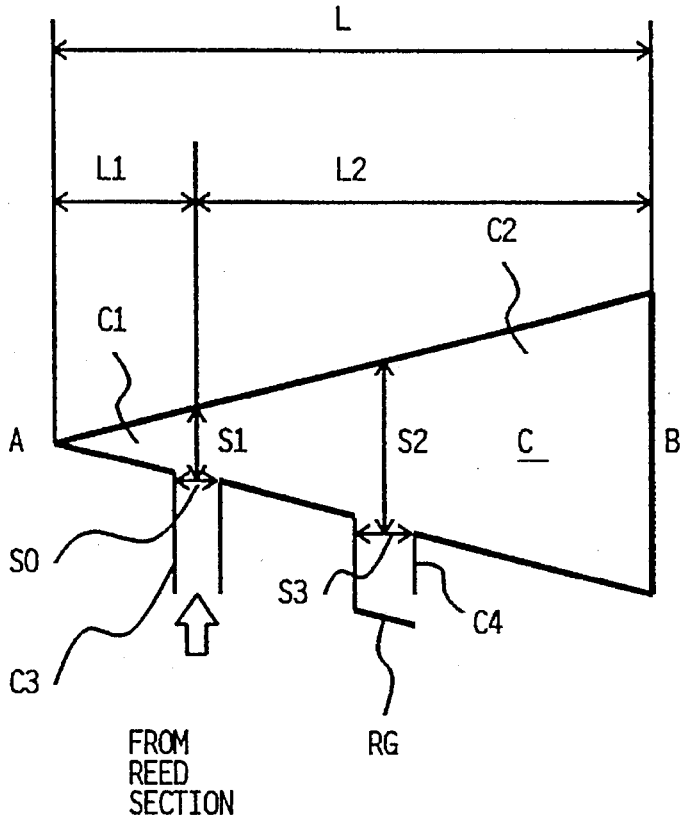
FIG. 2 is a cross sectional view illustrating the shape of a tubular structure of a wind instrument that is simulated by a linear section of the wind instrument model.

FIG. 2 illustrates in cross section the shape of the tubular body that is simulated by the linear section 2. The principal part of the tubular body C is in the shape of a hollow cone having apex A and base B. Reference character L represents the entire length of the tubular body from the apex A to the base B, and reference character S1 represents the location of a cross sectional area which is at distance L1 from the apex A and at distance L2 from the base B. The first part of the tubular body C having the length L1 from the apex A to the cross sectional area location S1 will be referred to as a first tubular portion C1. The remaining or second half of the tubular body C having the length L2 from the base B to the location S1 will be referred to as a second tubular portion C2.

At the cross sectional area location S1, there is defined an aperture having a cross sectional area S0, to which one end of a third tubular portion C3 is connected. The reed section is connected to the other end of the third tubular portion C3, so as to allow air flow to be introduced from the reed section. At the cross sectional area location S2 in the second tubular portion C2, there is defined a register aperture having a cross sectional area S3, to which one end of a fourth tubular portion C4 is connected. A register key RG for opening and closing the register aperture is provided on the other end of the tubular body C4, In this manner, the tubular body C is composed of the first to fourth tubular portions C1, C2, C3, C4.

The circuit structure of the linear section 2 shown in FIG. 3 will now be described in comparison with the tubular body structure shown in FIG. 2. The tubular portion simulating circuit 22 of FIG. 3 corresponds to the third tubular potion C3, and the junction portion simulating circuit 21 corresponds to the junction portion between the third tubular portion C3 and reed section of FIG. 2. The tubular portion simulating circuit 22 includes a loop circuit for simulating a waveshape signal propagating in the third tubular portion C3. This loop circuit circulates the waveshape signal from the adder 203 through the delay circuit 205, the adder 206 and the delay circuit 204 then back to the adder 203. The delay time Dm achieved by the delay circuits 204, 205 is determined by the length of the corresponding third tubular portion C3. The multipliers 207, 214, 218 and adder 208 of FIG. 3 correspond to the junction portion formed among the tubular portions C1, C2, C3.

The tubular portion simulating circuit 23 of FIG. 3 corresponds to the first tubular portion C1 of FIG. 2. The tubular portion simulating circuit 23 includes a loop circuit for simulating a waveshape signal propagating in the first tubular portion C1. This loop circuit circulates the waveshape signal from the adder 209 through the delay circuit 210, the low-pass filter 211, the multiplier 212 and the delay circuit 213 then back to the adder 209. The delay times DL1, DL1' achieved by the delay circuits 210, 213 are determined by the length L1 of the corresponding first tubular portion C1. The low-pass filter 211 and the multiplier 212 cooperate to simulate the reflection characteristics at the end portion (adjacent to the apex A) of the first tubular portion C1.

The tubular portion simulating circuits 24, 25 of FIG. 3 correspond to the second tubular portion C2 of FIG. 2. These tubular portion simulating circuits 24, 25 each include a loop circuit for simulating a waveshape signal propagating in the second tubular portion C2. The loop circuit of the simulating circuit 24 circulates the waveshape signal from the adder 219 through the delay circuit 220, the adder 216 and the delay circuit 217 then back to the adder 219. The loop circuit of the simulating circuit 25 circulates the waveshape signal from the adder 222 through the delay circuit 223, the low-pass filter 224, the multiplier 225 and the delay circuit 226 then back to the adder 222. The delay times DL21, DL21', DL22, DL22' achieved by the delay circuits 217, 220, 223, 226 are determined by the length L2 of the corresponding second tubular portion C2. The low-pass filter 224 and the multiplier 225 cooperate to simulate the reflection characteristics at the end portion (adjacent to the base B) of the second tubular portion C2. The multipliers 221, 227, 222 and adder 225 correspond to the junction portion between the tubular portions C2 and C4.

The tubular portion simulating circuit 26 of FIG. 3 corresponds to the fourth tubular portion C4 of FIG. 2. The tubular portion simulating circuit 26 includes a loop circuit for simulating a waveshape signal propagating in the fourth tubular portion C4. This loop circuit circulates the waveshape signal from the adder 228 through the delay circuit 229, the low-pass filter 230, the multiplier 231 and the delay circuit 232 then back to the adder 228. The delay time Dh achieved by the delay circuits 229, 232 is determined by the length of the corresponding fourth tubular portion C4. The low-pass filter 230 and multiplier 231 cooperate to simulate the reflection characteristics in the fourth tubular portion C4. In particular, the multiplier 231 corresponds to the above-mentioned register key RG of FIG. 3 that is movable for opening and closing the register aperture in the fourth tubular portion C4. The multiplier 231 simulates the closed state of the register key RG when multiplication coefficient RGKD (which is supplied as a parameter as will be described later) is substantially "1" and simulates the open state when the multiplication coefficient RGKD is substantially "−1".

By thus arranging the wind instrument model of FIG. 2 and the circuit structure of FIG. 3 in corresponding relation with each other, the respective delay times of the delay circuits and the respective multiplication coefficients of the multipliers in FIG. 3 can be determined in the following manner:

$$k1=2 * S0/(S0+S1+S1/L1)$$

$$k2=2 * S1/(S0+S1+S1/L1)$$

$$k3=2 * (S1/L1)/(S0+S1+S1/L1)$$

$$DL1+DL1'=2 * L1/c$$

$$DL21+DL21'+DL22+DL22'=2 * L2/c$$

in which k1, k2 and k3 represent respective multiplication coefficients of the multipliers 207, 218, 214, DL1, DL1', DL21, DL21', DL22 and DL22' represent respective delay times of the delay circuits 210, 213, 217, 220, 223, 226, and c represents the sonic speed.

Further, $$k4=k5=2 * S2/(2 * S2+S3)$$

$$k6=2 * S3/(2 * S2+S3)$$

$$DL22+DL22'=2 * L/nc$$

in which k4, k5 and k5 represent respective multiplication coefficients of the multipliers 221, 227, 233, and n represents an operation mode of the tubular body. The resonance frequency of the tubular body is determined in accordance with the open/closed state of the register key and the location of the register aperture, and a value representing the operation state of the register key signifies the operation mode (hereinafter referred to as "linear section operation mode") of the tubular body. It is assumed here that a state in which plural register keys are all closed is a first-order operation mode (n=1), a state in which predetermined one of the plural register key (for example, one provided in the center of the tubular body) is open is a second-order operation mode (n=2), a state where another register key is open is a third-order operation mode, and so on. However, the following description will be made on the assumption that in the circuit structure employed in this embodiment, only one register key is provided in the center of the tubular body and therefore the linear section operation mode is either the first-order mode or the second-order mode.

Further, it is assumed that, as mentioned earlier, in response to the movement of the reed section, the operation mode of the non-linear section 1 is one of a first-order mode (mode which causes resonance at fundamental frequency f), a second-order mode (mode which causes resonance at frequency 2f twice as higher as the fundamental frequency f) . . . n-order mode (mode which causes resonance at frequency nf n times as high as the fundamental frequency f).

The waveshape signal (excitation signal) output from the non-linear section 1 via the signal line 3 is input to the adders 203 and 201 of the junction portion simulating circuit 21 in the linear section 2. The adder 203 adds together the excitation signal from the multiplier 108 and the waveshape signal from the delay circuit 204 and then outputs the addition result or sum to the delay circuit 205. The waveshape signal of the reflected wave from the delay circuit 204 is multiplied by a constant "2" by means of the multiplier 202 and then input to the adder 202. The adder 201 adds together the excitation signal supplied through the signal line 3 and the waveshape signal from the multiplier 202, and it then returns the sum through the signal line 4. By such an operation of the junction portion simulating circuit 21, synthesis of incident and reflected waves in the junction portion between the reed section and the tubular body can be simulated.

The waveshape signal input to the junction portion 21 is also routed to the loop circuit of the tubular portion simulating circuit 22 and then caused to propagate to the simulating circuits 23, 24, 25, 26, where the signal circulates through the respective loop circuits. This simulates such conditions that air is blown into the tubular body C of FIG. 2 to cause resonance. The ultimate output may be taken out from any suitable locations of the linear section 2.

Figure 4:
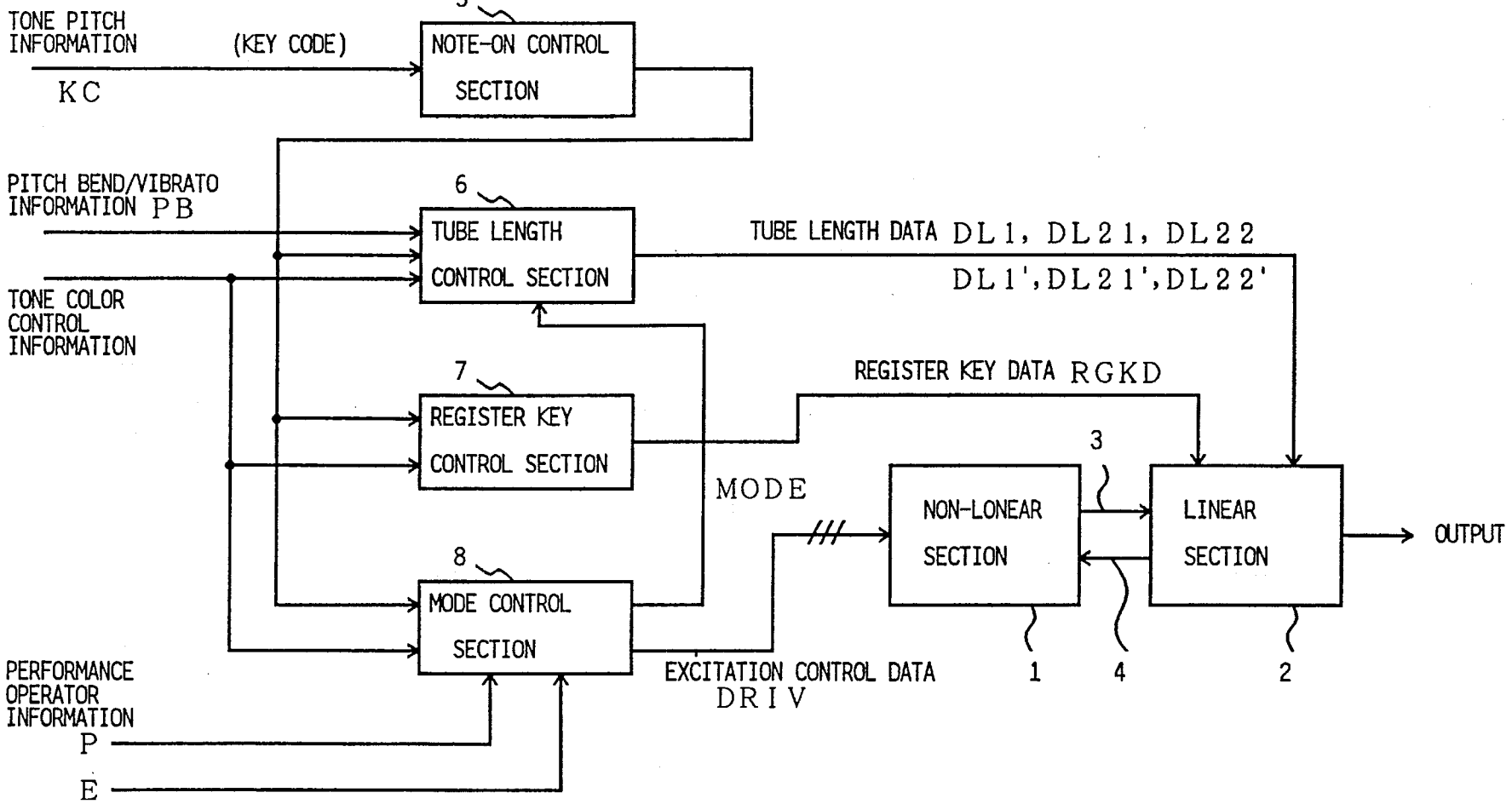
FIG. 4 is a block diagram illustrating the tone waveshape signal forming device in accordance with the embodiment of the present invention

FIG. 4 is a block diagram illustrating the structure of the tone waveshape signal forming device according to the preferred embodiment of the present invention. The tone waveshape signal forming device according to this embodiment includes the non-linear section 1 and linear section 2 of the wind instrument model as described in connection with FIGS. 1 to 3. The tone waveshape signal forming device also includes a note-on control section 5, a tube length control section 6, a register key control section 7 and a mode control section 8.

To this tone waveshape signal forming device are input tone pitch information, tone color control information, pitch bend/vibrato information and performance operator information. The tone pitch information and performance operator information will collectively be referred to as performance information. The tone pitch information comprises key code KC specifying the pitch of a tone waveshape signal to be generated. The tone color control information comprises information specifying the tone color of a waveshape signal to be generated, for instance, the tone color control information selects a specific tone color depending upon what kind of natural musical instrument tone is to be simulated. The pitch bend/vibrato information PB relates to pitch bend and vibrato effects. The performance operator information comprises pressure data P and embouchure data E. The tone pitch information and the performance operator information may be entered, for example, via unillustrated performance operators. For example, ON/OFF of tone generation may be controlled in accordance with presence or absence of the pressure data P, and the volume of generated tone may be control in accordance with the magnitude of the pressure data P.

In response to the above-mentioned various information, the note-on control section 5, tube length control section 6, register key control section 7 and mode control section 8 shown in FIG. 4 generate respective parameter data to be supplied to the non-linear and linear sections 1, 2. In response to the parameter data, determination is made of an operation mode in the non-linear section 1 (non-linear section operation mode) and also of the length of the tubular body and the state of the register key (linear section operation mode and resonance frequency) that are to be simulated in the linear section 2.

Now, description will be made on an example operation of the embodiment, in which the non-linear section 1 and the linear section 2 operate under conditions in items (1) to (5). Namely, such conditions as in items (1) to (5) are established for a currently selected tone color. For convenience of description, key codes specifying tone pitches are here expressed in pitch names. It is also assumed that the pitch range of tones to be generated in this embodiment is six octaves ranging from the lowest-pitch key code C0 through C0#, D0, D0#. . . up to the highest-pitch key code B5. As previously mentioned in connection with FIG. 3, in the wind instrument model employed in this embodiment, the register key is provided in the center of the tubular body and the linear section operation mode is either the first-order mode (the register key is in the closed state) or the second-order mode (the register is in the open state).

(1) When the key code is within a range from C0 and B2: The length of the tubular body to be simulated is changed in accordance with the key code. The register key is put in the closed state, and the non-linear section operation mode is set to the first-order mode.

(2) When the key code is within a range from C3 to B3: The tubular body length for the key codes C2–B2 is used. The register key is put in the open state, and the non-linear section operation mode is set to the first-order mode. Because the register key in the center of the tubular body is put in the closed state while using such a tube length that will generate tones of key codes C2–B2 if the register key stays in the closed state, a tone of one octave higher range C3–B3 is generated.

(3) When the key code is within a range from C4 to B4: The tubular body length for key codes C2–B2 is used. The register key is put in the open state, and the non-linear section operation mode is set to the second-order mode. Because the register key in the center of the tubular body is put in the open state while using such a tube length that will generate tones of key codes C2–B2 if the register key stays in the closed state, and also because the non-linear section operation mode is the second-order mode, a tone of two octave higher range C4–B4 is generated.

(4) When the key code is within a range from C5 to F5#: The tubular body length for key codes F2–B2 is used. The register key is put in the open state, and the non-linear section operation mode is set to the third-order mode. Because the register key in the center of the tubular body is put in the open state while using such a tube length that will generate tones of key codes F2–B2 if the register key stays in the closed state, a tone to be generated is one octave higher. Further, because the non-linear section operation mode is the third-order mode, a tone to be generated is made still higher by one octave and five degrees. Therefore, the ultimate result is that a tone of range C5–F5# is generated.

(5) When the key code is within a range from G5 to B5: The tubular body length for key codes C2–B2 is used. The register key is put in the open state, and the non-linear section operation mode is set to the fourth-order mode. Because the register key in the center of the tubular body is put in the open state while using such a tube length that will generate tones of key codes G2–B2 if the register key stays in the closed state, and also because the non-linear section operation mode is the fourth-order mode, a tone of three octave higher range G5–B5 is generated.

Next, the individual sections of the tone waveshape signal forming device according to this embodiment will be described in detail, again with reference to FIG. 4.

First, the note-on control section 5 will be described. This note-on control section 5 makes a comparison between the currently input or new key code and the last reproduced key code (key code having been sounded last time)—it is assumed that the last reproduced key code is stored in an interior memory—. Only when the two key codes do not coincide with each other, the note-on control section 5 outputs the new input key code KC to the following three control sections 6, 7, 8 so as to effect a key code change. No key code change is effected when the new key code KC coincides with the last reproduced key code.

Next, the tube length control section 6 will be described. The tube length control section 6 receives the key code KC, tone color control information, pitch bend/vibrato information PB and linear section operation mode information MODE, in accordance with which it generates tube length data DL1, DL21, DL22. The linear section operation mode information indicative of the linear section operation mode is generated from the mode control section 8.

The delay times of the individual delay circuits and the multiplication coefficients of the individual multipliers as shown in FIG. 3 must have been established when the linear section 2 is put into operation. So, according to this embodiment, arrangements are made such that the tube length control section 6 provides the linear section 2 with the respective delay times DL1, DL21, DL22 (it is assumed that DL1'=DL1, DL21'=DL21, and DL22'=DL22) of the delay circuits 210, 217, 223, and the register key control section 7 (which will be detailed later) provides the linear section 2 with the register key data RGKD. It is also assumed that other parameters to be supplied to the linear section 2 have already been established in advance in accordance with the currently selected tone color.

Figure 5:
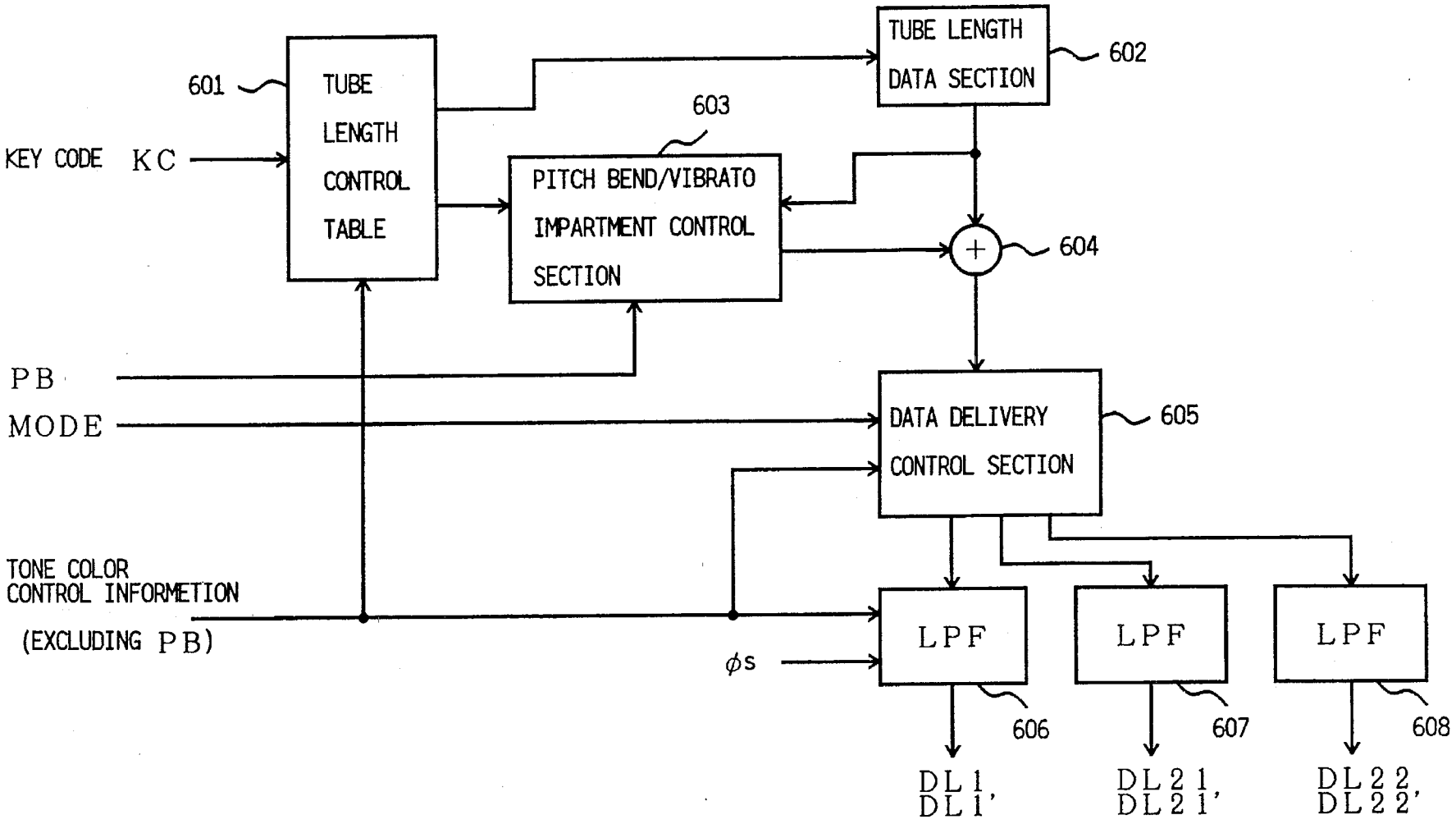
FIG. 5 is a block diagram illustrating an example of a tube length control section shown in FIG. 4.

FIG. 5 illustrates the structure of the tube length control section 6 in block diagram. As shown, the tube length control section 6 comprises a tube length control table section 601, a tube length data section 602, a pitch bend/vibrato impartment control section 603, an adder 604, a data delivery control section 605 and a plurality of low-pass filters 606, 607, 608.

The tube length control table section 601 outputs tube length selection data and tube length compensation data which correspond to the key code KC, with reference to a table corresponding to the selected tone color. In FIG. 6A, there are shown contents of the tube length control table section 601. Although the key codes are represented here by pitch names for facilitating the explanation, the key codes that are actually supplied to the tube length control table section 601 are numerical value data corresponding to plural selectable tone colors. For each tone color, the tube length control table section 601 has a table similar to that shown in FIG. 6A. Here, a table of the contents shown in FIG. 6A has been selected in view of the currently selected tone color so as to satisfy the conditions in the items (1) to (5) above. Which one of the tables should be used is determined on the basis of the tone color control information.

The tube length selection data of FIG. 6A is intended for selecting the entire length L of the tubular body to be simulated. The tube length selection data is output from the tube length table section 601 to the tube length data section 602. The tube length data section 602 outputs tube length data L in accordance with the input tube length selection data. The tube length data L corresponds to the entire length L of the tubular body model shown in FIG. 2. Thus, the entire length L is caused to be longer as the value of the tubular selection data increases.

The tubular length compensation data is intended for compensating the entire tube length L of the tubular body to be simulated. In the table of FIG. 6A, when the key code is within a range from C0 to B2, only the tube length L varies, and the tube length compensation data is maintained at "0" since the register key is in the closed state and the non-linear section operation mode is the first-order mode, requiring no tube length compensation. When generating a tone of a pitch equivalent to or higher than key code C3, there occurs some pitch difference since the register key is put in the open state (the linear section operation mode is set to the second-order mode or higher mode) and the non-linear section operation mode is set to the second-order mode or higher mode. Thus, it is necessary to compensate the tube length L to some extent, and therefore respective predetermined tube length compensation data are output for the key codes equivalent to or higher than C3.

The tube length compensation data is provided to the pitch bend/vibrato impartment control section 603, to which the pitch bend/vibrato information PB and the tube length data L are also provided. The reason why the tube length data L is provided is to time-vary the tube length as a percentage of the tube length data L. In accordance with these information, the pitch bend/vibrato impartment control section 603 outputs data indicative of a change in the tube length L. This tube length change data is added to the tube length data L by the adder 604 and then provided to the data delivery control section 605.

In accordance with the tone color specified by the tone color control information and the linear section operation mode information MODE, the data delivery control section 605 allocates the tube length data L to the tube length data DL1, DL21, DL22. The tube length data DL1, DL21, DL22 are then output to the linear section 2 via the respective low-pass filters 606, 607, 608. The respective low-pass filters 606, 607, 608 are provided to progressively vary the tube length because an abrupt change in the tube length, namely, in the delay times of the delay circuits in the linear section 2 may produce unwanted inconveniences such as noise. The respective low-pass filters 606, 607, 608 operate at sampling frequency $\phi s$.

The data delivery control section 605 makes a comparison between the current tube length data DL1, DL21, DL22 to be output and the last output tube data (which are, for example, stored in the interior memory) and outputs only the current tube length data DL1, DL21, DL22 which do not coincide in value with the corresponding last output tube length data. No change or renewal of the tube length data DL1, DL21, DL22 is effected when all the current tube length data coincide with the last output tube length data.

Next, the register key control section 7 will be described, again with reference to FIG. 4. The register key control section 7 receives the key code KC and the tone color control information, and it generates the register key data RGKD (data indicative of the closed or open state of the register key) to be given to the linear section 2 by referring to a table corresponding to the currently selected tone color.

Because the above-mentioned conditions (1) to (5) are established for the currently selected tone color, a table as shown in FIG. 6B is used. Namely, as for the key code within a range from C0 to B2, tones of individual pitches are generated by changing only the tube length L with the register key maintained in the closed state, and hence the register key data RGKD is maintained at +1. As for the key codes equivalent to or higher than C3, tones of individual pitches are generated by changing the tube length L and the non-linear section operation mode with the register key maintained in the open state, and hence the register key data RGKD is maintained at −1.

The register key control section 7 has a table similar to that shown FIG. 6B for each tone color. Which one of the tables should be used is determined on the basis of the tone color control information. Further, the register key control section 607 makes a comparison between the current register key data RGKD to be output and the last output register key data (which is, for example, stored in the interior memory) so that it outputs only the current register key data RGKD which does not coincide with the last output register key data. No change of the register key data RGKD is effected when the current register key data with the last output register key data.

Next, the mode control section 8 of FIG. 4 will be described. This mode control section 8 receives the key code KC, tone color control information, pressure data P and embouchure data E, in accordance with which the section 8 generates excitation control data DRIV to be given to the non-linear section and linear section operation mode information MODE to be given to the tube length control section 6. The excitation control data DRIV is a group of the parameter data to be given to the non-linear section 1 as previously described in connection with FIG. 3. More, specifically, the excitation control data DRIV comprises embouchure data EB, pressure data PRES, cut-off frequency fc of the reed, parameter Q indicative of the peak sharpness Q and slit gain G.

Although, in practice, other parameters such as parameter SLT specifying a slit function table, parameter GRM specifying a graham function table and multiplication coefficient Z of the multiplier 106 must be established in the non-linear section 1 of FIG. 3, it is assumed here that these parameters have been determined in advance in accordance with the currently selected tone color.

Figure 7:
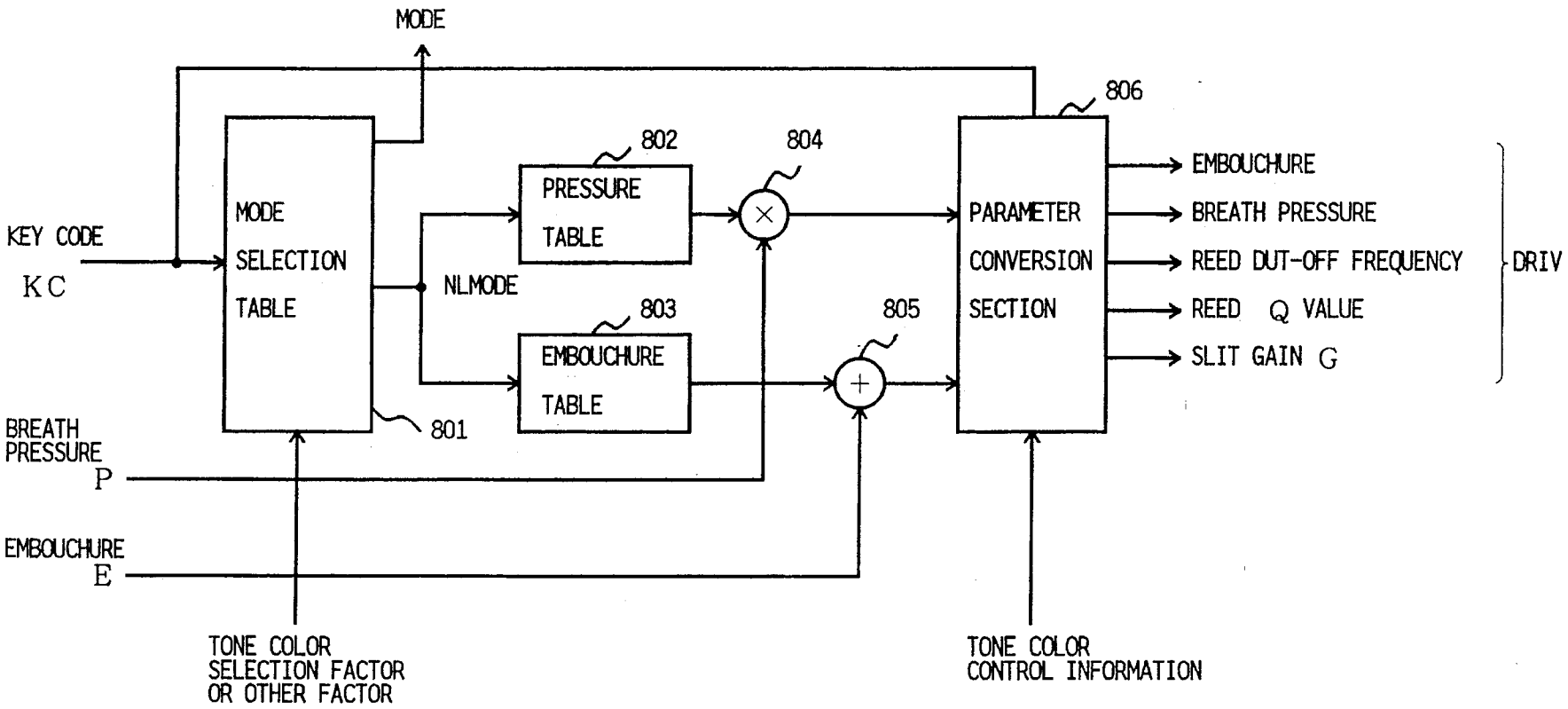
FIG. 7 is a block diagram illustrating an example of a mode control section shown in FIG. 4.

In FIG. 7, there is shown the mode control section 8 in block diagram. The mode control section 8 comprises a mode selection table 801, a pressure table 802, an embouchure table 803, a multiplier 804, an adder 805 and a parameter conversion section 806.

In accordance with the input key code KC, the mode selection table 801 outputs the linear section operation mode information MODE and the non-linear section operation mode information NLMODE. FIG. 8A shows contents of the mode selection table 801, in which mode information corresponding to the key codes KC is registered in accordance with the above-mentioned conditions (1) to (5). The linear section operation mode information MODE output from the mode selection table 801 is input to the tube length control section 6 as previously mentioned. In addition, the non-linear section operation mode information NLMODE is input to the pressure table 802 and the embouchure table 803.

The pressure table 802 outputs a pressure coefficient corresponding to the input non-linear section operation mode information NLMODE. FIG. 8B shows contents of the pressure table 802. The pressure coefficient output from the pressure table 802 is multiplied by the pressure data P (input performance operator information) by means of the multiplier 804. With this multiplication, the pressure is modified in accordance with the tone pitch.

For example, when a natural recorder is played with a relatively strong blow, there may be generated a tone of a pitch one octave higher than with a weaker blow although the same finger action is employed. This indicates that it is better to increase the pressure data value in order to raise the non-linear section operation mode to a higher mode. Therefore, according to the embodiment, arrangements are such that the pressure coefficient to be multiplied with the pressure data P increases in value as the non-linear section mode information MODE gets greater.

The embouchure table 803 outputs an embouchure offset data corresponding to the input non-linear section operation mode information NLMODE. FIG. 8C shows contents of the embouchure table 803. The embouchure offset data output from the embouchure table 803 is added with the embouchure data E (input performance operator information) by means of the adder 805. With this addition, the embouchure is modified in accordance with the tone pitch.

The pressure data output from the multiplier 804 is input to the parameter conversion section 806, from which the data is directly output as the pressure data PRES. Similarly, the embouchure data output from the adder 805 is input to the parameter conversion section 806, from which the data is directly output as the embouchure data EB. As a modification, there may be provided tables corresponding to the selectable tone colors so that a table is looked up in accordance with the tone pitch and then output after scaling of the pressure and embouchure.

Further, by referring to respective tables corresponding to the selected tone color, the parameter conversion section 806 outputs the cut-off frequency fc, parameter Q and slit gain G which correspond to the tone pitch. Such tables of the cut-off frequency fc, parameter Q and slit gain G are provided for each selectable tone color. Moreover, there are some natural wind instruments which are capable of changing the operation mode of the reed section by biting the reed or by applying an increased pressure thereto. To simulate these natural wind instrument, the cut-off frequency fc, parameter Q and slit gain G suitable may be newly generated or modified in accordance with the applied pressure and utilized embouchure. Excitation frequency settings corresponding to the order of the non-linear section mode can be obtained by controlling the cut-off frequency fc and parameter Q in accordance with the non-linear section mode information to control the resonance characteristics of the reed dynamics filter 102.

Further, in a similar manner to the foregoing, the parameter conversion section 806 makes a comparison between the current data to be output this time and the last output data (which are, for example, stored in the interior memory) so that it newly outputs only such current data which do not coincide with the last output data. No change or renewal of the data is effected when all the current data coincide with the last output data.

According to the above-mentioned embodiment, generation (including modification) of parameters to be given to the non-linear and linear sections 1, 2 is performed in accordance with the selected tone color and tone pitch. Accordingly, such parameters as to accurately simulate natural musical instruments in accordance with the tone color and tone pitch can be supplied to the non-linear and linear sections 1, 2. In addition, when the tone color is changed, parameter generation is performed using tables corresponding to the newly selected tone color, and thus it is always allowed to simulate a natural musical instrument tone having the new tone color.

Moreover, according to the above-mentioned embodiment, the note-on control section 5, tube length control section 6 (in particular, data delivery control section 605), register key control section 7 and mode control section 8 (in particular, parameter conversion section 8) make a comparison between current data to be output this time and the last output data so as to output only such data that do not coincide with the last output data. Therefore, when, for example, tone signals of the same key code are generated, it is sufficient for both the linear and non-linear sections only to control the pressure and embouchure without performing any new key-on processing. Further, it is sufficient to change the closing; and opening conditions of the register key or to change the operation mode without changing the other parameter conditions. With such arrangements, it is possible to reduce the required processing amount and to realize more real and more natural connection of tones.

Although the above-mentioned embodiment employs various tables as shown in FIGS. 6A and 6B and 8A to 8C, it is also possible to perform various processings without using such tables. In particular, when the above-mentioned operations of the individual component sections are achieved by software, these tables can be replaced by mere determination and data setting processings.

Moreover, although, the above-mentioned embodiment, tables are provided for each tone color in various sections in such a manner that one suitable table is selected on the basis of the tone color control information, these tables may be prepared and established in these sections as tone colors are established or created.

Figure 9:
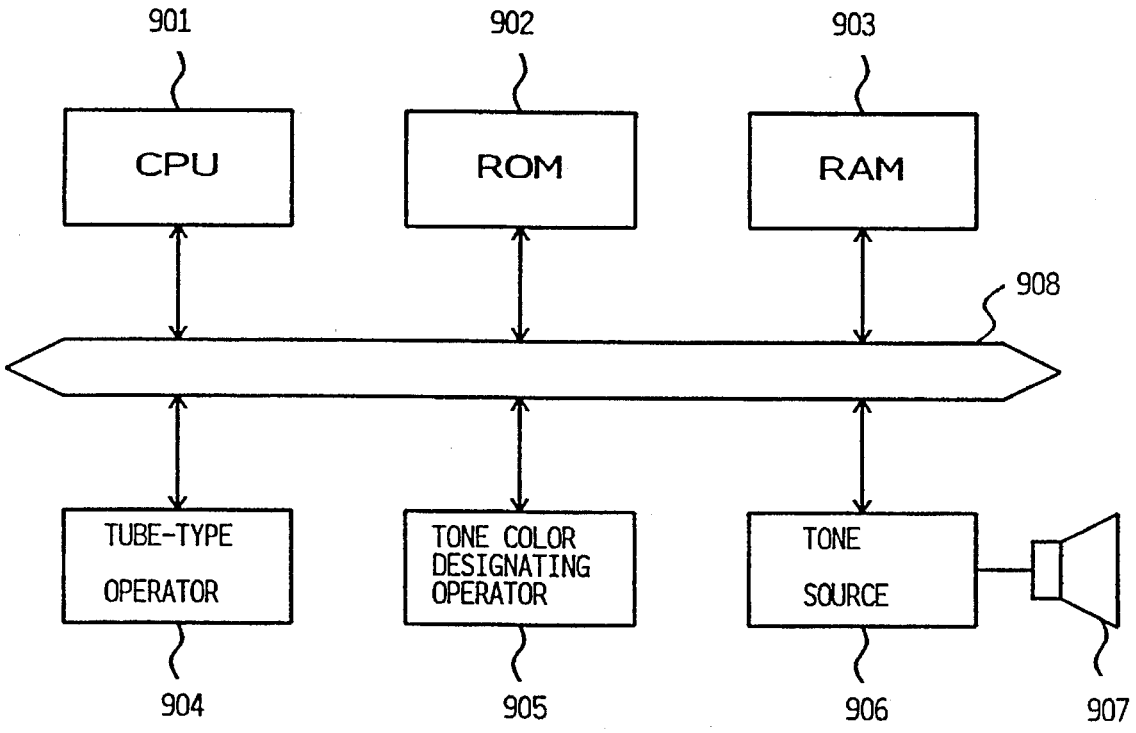
FIG. 9 is a block diagram illustrating an electronic musical instrument employing the tone waveshape signal forming device in accordance with the embodiment.

FIG. 9 shows an example of an electronic musical instrument that employs the tone waveshape signal forming device according to the above-mentioned embodiment. This electronic musical instrument comprises a central processing device (CPU) 901, a read-only memory (ROM) 902, a random access memory (RAM) 903, a tube-type performance operator 904, a tone color designating operator 905, a tone source 906, a sound system 907 and a bus line 908. The CPU 901 controls the entire operations of the electronic musical instrument. The ROM 902 stores therein programs to be executed by the CPU 901 and various tables. The RAM 903 is utilized as various working areas.

The tone color designating operator 905 outputs tone color control information in response to the player's tone color designating operation. In response to the player's performance action, the tube type performance operator 904 outputs key codes which are tone pitch designating information, pitch bend/vibrato information, and pressure and embouchure data which are performance operator information. The CPU 901 receives such tone color control information, key codes, pitch bend/vibrato information, and pressure and embouchure data and executes predetermined programs, to thereby generate tube length data DL1, DL21, DL22, register key data RGKD and excitation control data DRIV.

The CPU 901 and the programs stored in the ROM 902 correspond to the note-on control section 5, tube length control section register key control section 7 and mode control section 8 as previously described in connection with FIGS. 6A and 6B and 8A to 8C. The tables of FIGS. 6A and 6B and 8A to 8C may be stored in the ROM 902, or alternatively tables created in accordance with tone colors and stored in the RAM 903 may be used.

The tone source 906 corresponds to the wind instrument model described earlier in connection with FIGS. 1 to 3. This tone source 906 receives the tube length data DL1, DL21, DL22, register key data RGKD and excitation control data DRIV, and in accordance with these parameters it generate tone waveshape signals simulating a wind instrument. The thus-generated waveshape signals are input to the sound system 907 through which the signals are audibly reproduced as real tones. The tone source 906 may be implemented by discrete hardware circuitry or by a digital signal processor (DSP).

As has been thus far described, according to the present invention, in a tone waveshape signal forming device where parameters generated on the basis of selected tone pitch information are input to its waveshape signal circulation means and excitation signal generation means, the last selected tone pitch information and the currently selected tone pitch information are compared with each other (or the last first parameters and the current first parameters are compared with each other), so that when there is no change, i.e., when the current parameters are the same as the last parameter, no new parameter is output to the waveshape signal circulation means. With such arrangements, it is allowed to form tone waveshape signals that accurately simulate tones of a natural musical instrument, particularly of a wind instrument and to achieve more real and natural connection of tones.

What is claimed is:

1. A tone signal synthesizer comprising:

signal circulation means including a bidirectional signal transmitting channel section which has a channel for transmitting a wave signal in an advancing direction and a channel for transimitting the wave signal in a reflecting direction, and a signal junction section for controlling advancement and reflection of the wave signal at a boundary of said signal transmitting channel section, a delay time in said signal transmitting channel section being variably controlled by a first parameter group so as to control a resonance characteristic of said signal circulation means;

excitation means for exciting the wave signal to be supplied to said signal circulation means, an excitation frequency of said excitation means being controlled in accordance with a second parameter group, the wave signal circulating in said signal circulation means being taken out as a tone signal, a pitch of said tone signal being determined by a combination of the resonance frequency of said signal circulation means and the excitation frequency of said excitation means;

combination determination means for determining a combination of the first parameter group to be used in said signal circulation means and the second parameter group to be used in said excitation means, in correspondence to a pitch of a tone to be generated; and parameter generation means for, in accordance with the combination determined by said determination means, generating individual parameters of said first and second parameter groups and supplying thus-generated parameters to said signal circulation means and excitation means.

2. A tone signal synthesizer as defined in claim 1, wherein said combination determination means determines the combination of the first and second parameter groups corresponding to the pitch, in a mode peculiar to each selected tone color.

3. A tone signal synthesizer as defined in claim 1, wherein said combination determination means includes mode designation means for designating an operation mode of each of said signal circulation means and excitation means in correspondence to the pitch of the tone to be generated, said parameter generation means generates the individual parameters of the first and second parameter groups in correspondence to the designated operation modes of said signal circulation means and excitation means, respectively, and said signal circulation means and excitation means are set to the respective designated operation modes in accordance with the individual parameters of the first and second parameter groups supplied from said parameter generation means.

4. A tone signal synthesizer as defined in claim 3, wherein said mode designation means includes a plurality of tables that designate combinations of the operation modes of said signal circulation means and excitation means corresponding to individual pitches, and said mode designation means selects one of said tables in accordance with a predetermined table selection factor and uses the selected table to designate the operation modes of said signal circulation means and excitation means in correspondence to the pitch of the tone to be generated.

5. A tone signal synthesizer as defined in claim 1, wherein said signal circulation means includes a plurality of said bidirectional signal transmitting channel sections and one or more said signal junction sections provided at the boundary of each of said bidirectional signal transmitting channel sections, said first parameter group containing a parameter for setting a delay time in each of said bidirectional signal transmitting channel sections, a parameter for controlling a closing or opening condition at an end of predetermined one of said bidirectional signal transmitting channel sections, and a coefficient parameter for controlling the advancement and reflection of the wave signal at said signal junction section.

6. A tone signal synthesizer as defined in claim 1, wherein each time generation of a tone is instructed, the individual parameters of the first and second parameter groups corresponding to a pitch of a tone to be generated are generated through an cooperation of said combination determination means and parameter generation means, and which further comprises means for, when there is instructed generation of a tone of a same pitch name as a last generated tone, maintaining the individual parameters of the first parameter group used for the last generated tone, so as not to effect a parameter change processing for said signal circulation means.

7. A tone signal synthesizer as defined in claim 1 wherein at least said signal circulation means and excitation means are implemented by use of a processor of a type which processes a digital signal in accordance with a program.

8. A digital sound synthesizer comprising:

signal circulation means forming a closed loop for circulating therein a digital signal, said signal circulation means including, within said closed loop, delay means for delaying the digital signal, a delay time by said delay means being variably controlled by a first parameter group so as to control a resonance characteristic of said signal circulation means;

excitation means for exciting the digital signal to be supplied to said signal circulation means, an excitation frequency of said excitation means being controlled in accordance with a second parameter group, the digital signal circulating in said signal circulation means being taken out as a sound signal, a pitch of said sound signal being determined by a combination of the resonance frequency of said signal circulation means and the excitation frequency of said excitation means;

combination determination means for determining a combination of the first parameter group to be used in said signal circulation means and the second parameter group to be used in said excitation means, in correspondence to a pitch of a sound to be generated; and parameter generation means for, in accordance with the combination determined by said determination means, generating individual parameters of said first and second parameter groups and supplying thus-generated parameters to said signal circulation means and excitation means.

9. A digital sound synthesizer as defined in claim 8, wherein at least said signal circulation means and excitation means are implemented by use of a processor of a type which processes a digital signal in accordance with a program.

10. A sound synthesizer comprising:

signal circulation means for circulating therein a wave signal, said signal circulation means receiving one or more predetermined first parameters in correspondence to a designated pitch and being controlled by the received first parameters;

excitation means for exciting the wave signal circulating in said circulation means, said excitation means receiving one or more predetermined second parameters in correspondence to the designated pitch and having an excitation characteristic controlled by the received second parameters; and control means for receiving information designating a pitch of a sound to be generated, generating said first and second parameters in accordance with said information and supplying said first and second parameters to said signal circulation means and excitation means, whereby a sound signal having a pitch determined by a combination of said first and second parameters is synthesized.

11. A sound synthesizer as defined in claim 10 wherein said control means makes a comparison between a pitch designated for a last generated sound and a pitch designated for a sound to be currently generated, and if there is no change between the pitch for the last generated sound and the pitch for the sound to be currently generated, said control means retains, for the sound to be currently generated, said first parameters supplied for the last generated sound.

12. A sound synthesizer as defined in claim 10 wherein said control means makes a comparison between the first parameters based on the pitch designated for the last generated sound and the first parameters based on the pitch designated for the sound to be currently generated, and if there is no change between the first parameters for the last generated sound and the first parameters for the sound to be currently generated, said control retains, for the sound to be currently generated, said first parameters supplied for the last generated sound.

13. A sound synthesizer as defined in claim 10 wherein at least said signal circulation means and excitation means are implemented by use of a processor of a type which processes a digital signal in accordance with a program.

14. A method of synthesizing a sound signal comprising the steps of:

forming a closed loop for circulating therein a wave signal, a circulation characteristic of the wave signal being variably controlled by first parameter data;

exciting the wave signal to be circulated in said closed loop with a given excitation characteristic, said excitation characteristic being controlled in accordance with second parameter data;

supplying said first and second parameter data in correspondence to a desired pitch of a sound to be synthesized: and taking out the wave signal from said closed loop as a sound signal, an actual pitch of said sound signal being determined by a combination of said circulation and excitation characteristics.

15. A method as defined in claim 14 wherein said step of supplying said first and second parameter data comprises:

determining a combination of said first and second parameter data to be used from among plural combinations of said first and second parameter data;

generating individual parameters of said first and second parameter data in accordance with said combination.

* * * * *